US011230819B2

(12) United States Patent
Yamashita et al.

(10) Patent No.: US 11,230,819 B2
(45) Date of Patent: Jan. 25, 2022

(54) CONSTRUCTION MACHINE

(71) Applicant: Hitachi Construction Machinery Co., Ltd., Tokyo (JP)

(72) Inventors: Ryohei Yamashita, Tsuchiura (JP); Kazushige Mori, Tsuchiura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 331 days.

(21) Appl. No.: 16/490,982

(22) PCT Filed: Mar. 19, 2018

(86) PCT No.: PCT/JP2018/010908
§ 371 (c)(1),
(2) Date: Sep. 4, 2019

(87) PCT Pub. No.: WO2019/180798
PCT Pub. Date: Sep. 26, 2019

(65) Prior Publication Data
US 2021/0324602 A1 Oct. 21, 2021

(51) Int. Cl.
*E02F 3/43* (2006.01)
*E02F 9/22* (2006.01)
(Continued)

(52) U.S. Cl.
CPC ..... *E02F 3/436* (2013.01); *E02F 9/2242* (2013.01); *E02F 9/2282* (2013.01);
(Continued)

(58) Field of Classification Search
None
See application file for complete search history.

(56) References Cited

U.S. PATENT DOCUMENTS 9,051,712 B2 * 6/2015 Kodaka ..... E02F 9/2285
9,341,198 B2 * 5/2016 Nakamura ..... F15B 15/20
(Continued)

FOREIGN PATENT DOCUMENTS

JP 7-119709 A 5/1995
JP 2013-181287 A 9/2013

OTHER PUBLICATIONS

International Search Report (PCT/ISA/210) issued in PCT Application No. PCT/JP2018/010908 dated Jun. 19, 2018 (three pages).
(Continued)

*Primary Examiner* — Michael Leslie
(74) *Attorney, Agent, or Firm* — Crowell & Moring LLP

(57) ABSTRACT

To provide a construction machine that can improve the energy efficiency in a leveling operation in which an arm crowding operation and a boom raising operation are performed simultaneously. A controller (30) controls a first regulator (60*a*) according to the maximum value among target displacement volume (Qa1) of a first hydraulic pump (1) that is based on a boom raising operation amount (Pi1), and target displacement volume (Qa2) of the first hydraulic pump (1) that is based on an arm crowding operation amount (Pi2) of an arm operation device (18) if the boom raising operation amount (Pi1) of a boom operation device (17) is smaller than a predetermined operation amount, or if a delivery pressure (P2) of a second hydraulic pump (2) is equal to or higher than a predetermined pressure, and controls the first regulator (60*a*) according only to the target displacement volume (Qa1) of the first hydraulic pump (1) that is based on the boom raising operation amount (Pi1) if the boom raising operation amount (Pi1) is equal to or larger than the predetermined operation amount, and the delivery pressure (P2) of the second hydraulic pump (2) is lower than the predetermined pressure.

4 Claims, 10 Drawing Sheets

(51) Int. Cl.
*F15B 11/17* (2006.01)
*F15B 11/16* (2006.01)

(52) U.S. Cl.
CPC ..... *E02F 9/2292* (2013.01); *F15B 11/167* (2013.01); *F15B 11/17* (2013.01); *E02F 9/2296* (2013.01)

(56) References Cited

U.S. PATENT DOCUMENTS

| | | | | |
|---|---|---|---|---|
| 9,938,691 | B2 * | 4/2018 | Hiraku | E02F 9/2217 |
| 10,309,079 | B2 * | 6/2019 | Moriki | E02F 9/2221 |
| 10,604,914 | B2 * | 3/2020 | Moriki | E02F 9/2235 |
| 10,677,274 | B2 * | 6/2020 | Kondo | E02F 9/2292 |
| 2020/0277755 | A1 * | 9/2020 | Kondo | F15B 1/024 |
| 2021/0189691 | A1 * | 6/2021 | Kondo | E02F 9/2292 |

OTHER PUBLICATIONS

Japanese-language Written Opinion (PCT/ISA/237) issued in PCT Application No. PCT/JP2018/010908 dated Jun. 19, 2018 (four pages).

International Preliminary Report on Patentability (PCT/IB/338 & PCT/IB/373) issued in in PCT Application No. PCT/JP2018/010908 dated Oct. 1, 2020, including English translation of (Japanese-language Written Opinion (PCT/ISA/237) filed on Sep. 4, 2019) (seven (7) pages).

* cited by examiner

CONSTRUCTION MACHINE

TECHNICAL FIELD

The present invention relates to a construction machine such as a hydraulic excavator, and in particular relates to a construction machine that drives a plurality of hydraulic actuators by using a variable displacement hydraulic pump.

BACKGROUND ART

Construction machines such as hydraulic excavators generally include hydraulic pumps, hydraulic actuators driven by hydraulic fluids delivered from those hydraulic pumps, and flow control valves that control supply and discharge of hydraulic fluids to and from those hydraulic actuators. Conventional techniques of hydraulic pump control systems that perform flow control of a hydraulic pump to drive a plurality of hydraulic actuators are disclosed, for example, in Patent Document 1.

Patent Document 1 describes a hydraulic pump control system including: a variable displacement hydraulic pump; a displacement varying mechanism for the variable displacement hydraulic pump; a regulator that controls a tilting amount of the displacement varying mechanism; a plurality of hydraulic actuators driven by the hydraulic pump; and each control valves that controls driving of one of the hydraulic actuators, the hydraulic pump control system being provided with: each operation amount sensor that senses an operation amount of one of the control valves; and a controller in which each tilting amount of the displacement varying mechanism corresponding to one of operation amounts sensed by one of the operation amount sensors, and a maximum tilting amount optimum for a hydraulic actuator corresponding to each of these tilting amounts are set, and that receives input of a sensing value of one of the operation amount sensors, and outputs the tilting amount corresponding to the sensing value to control the regulator, in which the controller includes: extracting means that is provided to each of the hydraulic actuators, and is for extracting the tilting amount corresponding to a sensing value of a corresponding operation amount sensor; and maximum value selecting means for selecting a maximum value among tilting amounts extracted by the extracting means.

PRIOR ART DOCUMENT

Patent Document

Patent Document 1: JP-1995-119709-A

SUMMARY OF THE INVENTION

Problems to be Solved by the Invention

There are construction machines such as hydraulic excavators on which two-pump type hydraulic drive systems are mounted. In this type of two-pump type hydraulic drive system, at a time of a leveling operation in which an arm crowding operation and a boom raising operation are performed simultaneously, one hydraulic pump (first hydraulic pump) supplies a hydraulic fluid mainly to a boom cylinder, and the other hydraulic pump (second hydraulic pump) supplies a hydraulic fluid mainly to an arm cylinder. If the hydraulic pump control system described in Patent Document 1 is applied to such a hydraulic drive system, problems like the ones explained below occur.

In a leveling operation, while the arm crowding operation amount is kept at the maximum from the start of the operation to the end of the operation, the boom raising operation amount is kept at the maximum in the first half of the operation, and decreases gradually in the second half of the operation. Here, the displacement volume (tilting amount) of the first hydraulic pump is controlled according to the maximum value among the target displacement volume of the first hydraulic pump that is based on the boom raising operation amount, and the target displacement volume of the first hydraulic pump that is based on the arm crowding operation amount, and the displacement volume of the second hydraulic pump is controlled according to the maximum value among the target displacement volume of the second hydraulic pump that is based on the boom raising operation amount, and the target displacement volume of the second hydraulic pump that is based on the arm crowding operation amount.

Accordingly, the displacement volume of the second hydraulic pump is, in the first half of the leveling operation, the maximum value among the maximum displacement volume of the second hydraulic pump that is based on the boom raising operation amount, and the maximum displacement volume of the second hydraulic pump that is based on the arm crowding operation amount, and is, in the second half of the leveling operation, the maximum displacement volume of the second hydraulic pump that is based on the arm crowding operation amount due to decrease of the boom raising operation amount.

On the other hand, the displacement volume of the first hydraulic pump is, in the first half of the leveling operation, the maximum value among the maximum displacement volume of the first hydraulic pump that is based on the boom raising operation amount, and the maximum displacement volume of the first hydraulic pump that is based on the arm crowding operation amount, and is, in the second half of the leveling operation, the maximum displacement volume of the first hydraulic pump that is based on the arm crowding operation amount due to decrease of the boom raising operation amount. As a result, there is a fear that, in the second half of the leveling operation, the tilting amount of the first hydraulic pump to supply a hydraulic fluid mainly to the boom cylinder becomes excessively large despite decrease of the boom raising operation amount, and the delivery pressure of the first hydraulic pump rises excessively, thereby resulting in deterioration of the energy efficiency.

The present invention has been made in view of the problems explained above, and an object thereof is to provide a construction machine that can improve the energy efficiency in a leveling operation in which an arm crowding operation and a boom raising operation are performed simultaneously.

Means for Solving the Problems

In order to achieve an object explained above, the present invention provides a construction machine including: a machine body; a boom attached to the machine body so as to be rotatable in an upward/downward direction; an arm attached to a front end portion of the boom so as to be rotatable in the upward/downward direction or in a forward/backward direction; a first hydraulic pump and second hydraulic pump that are of variable displacement type; a first regulator and a second regulator that adjust displacement volumes of the first hydraulic pump and the second hydraulic pump; a boom cylinder that is supplied with hydraulic fluids delivered from the first hydraulic pump and the second hydraulic pump and drives the boom; an arm cylinder that is supplied with hydraulic fluids delivered from the first hydraulic pump and the second hydraulic pump and drives the arm; a boom operation device that gives an instruction about operation of the boom; an arm operation device that gives an instruction about operation of the arm; an operation amount sensor that senses operation amounts of the boom operation device and the arm operation device; and a controller that controls the first regulator and the second regulator according to the operation amounts of the boom operation device and the arm operation device. The construction machine includes a pressure sensor that senses a delivery pressure of the second hydraulic pump. The controller: controls the second regulator according to a maximum value among a target displacement volume of the second hydraulic pump that is based on a boom raising operation amount of the boom operation device, and a target displacement volume of the second hydraulic pump that is based on an arm crowding operation amount of the arm operation device; controls the first regulator according to a maximum value among a target displacement volume of the first hydraulic pump that is based on the boom raising operation amount, and a target displacement volume of the first hydraulic pump that is based on the arm crowding operation amount if the boom raising operation amount is smaller than a predetermined operation amount or if the delivery pressure of the second hydraulic pump is equal to or higher than a predetermined pressure; and controls the first regulator according only to the target displacement volume of the first hydraulic pump that is based on the boom raising operation amount if the boom raising operation amount is equal to or larger than the predetermined operation amount, and the delivery pressure of the second hydraulic pump is lower than the predetermined pressure.

According to the thus-configured present invention, the displacement volume of the first hydraulic pump that supplies a hydraulic fluid mainly to the boom cylinder decreases according to reduction of the boom raising operation amount in a leveling operation in which an arm crowding operation and a boom raising operation are performed simultaneously. Thereby, the delivery pressure of the first hydraulic pump never rises excessively, and so it becomes possible to improve the energy efficiency.

Advantage of the Invention

According to the present invention, in a leveling operation in which an arm crowding operation and a boom raising operation are performed simultaneously, the delivery pressure of the hydraulic pump that supplies a hydraulic fluid mainly to the boom cylinder never rises excessively, and so it becomes possible to improve the energy efficiency.

MODE FOR CARRYING OUT THE INVENTION

Hereinafter, a hydraulic excavator is explained as an example of a construction machine according to an embodiment of the present invention with reference to the figures. Note that in the individual figures, equivalent members are given identical signs, and duplicate explanations are omitted as appropriate.

Figure 1:
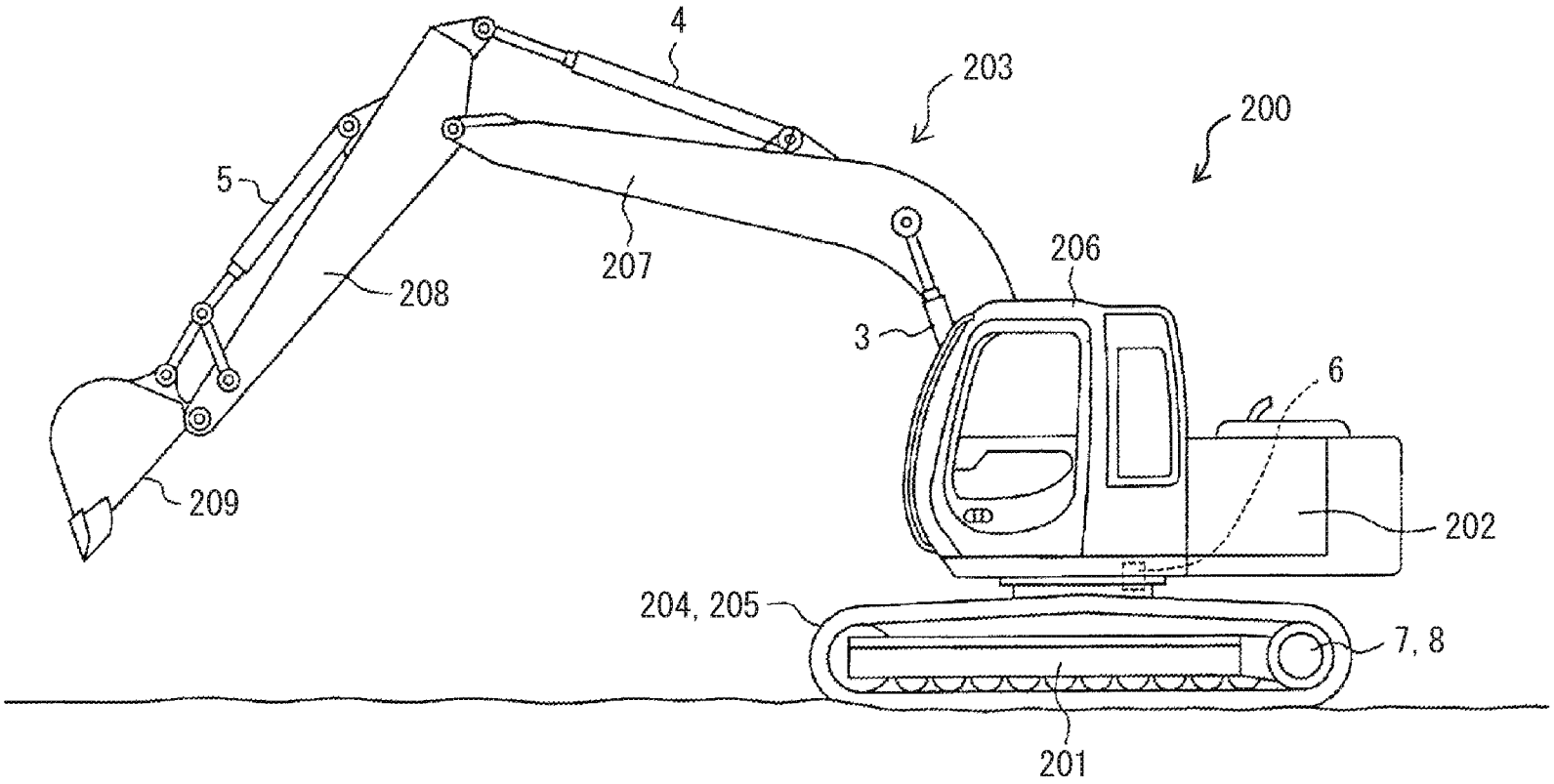
FIG. 1 is a side view illustrating a hydraulic excavator as one example of a construction machine according to an embodiment of the present invention.

FIG. 1 is a side view illustrating a hydraulic excavator according to the embodiment of the present invention.

In FIG. 1, the hydraulic excavator 200 includes a lower travel structure 201, an upper swing structure 202 that constitutes a machine body along with the lower travel structure 201, and a front work implement 203. The lower travel structure 201 has left and right crawler type travel devices 204 and 205 (only one side is illustrated), and is driven by left and right travel motors 7 and 8 (only one side is illustrated). The upper swing structure 202 is mounted on the lower travel structure 201 so as to be swingable, and is swing-driven by a swing motor 6. The front work implement 203 is attached to a front portion of the upper swing structure 202 so as to be rotatable in the upward/downward direction. The upper swing structure 202 is provided with a cabin (operation room) 206, and operation lever devices 17 and 18 that are mentioned below (see FIG. 2), and operation devices such as an operation pedal device for travelling that are unillustrated are arranged in the cabin 206.

The front work implement 203 includes: a boom 207 attached to a front portion of the upper swing structure 202 so as to be rotatable in the upward/downward direction; an arm 208 coupled to a front end portion of the boom 207 so as to be rotatable in the upward/downward or forward/backward direction; a bucket 209 coupled to a front end portion of the arm 208 so as to be rotatable in the upward/downward or forward/backward direction; boom cylinders 3 as hydraulic actuators that drive the boom 207; an arm cylinder 4 as a hydraulic actuator that drives the arm 208; and a bucket cylinder 5 as a hydraulic actuator that drives the bucket 209. The boom 207 rotates in the upward/downward direction relative to the upper swing structure 202 by extension and contraction of the boom cylinders 3, the arm 208 rotates in the upward/downward and forward/backward direction relative to the boom 207 by extension and contraction of the arm cylinder 4, and the bucket 209 rotates in the upward/downward and forward/backward direction relative to the arm 208 by extension and contraction of the bucket cylinder 5.

Figure 2:
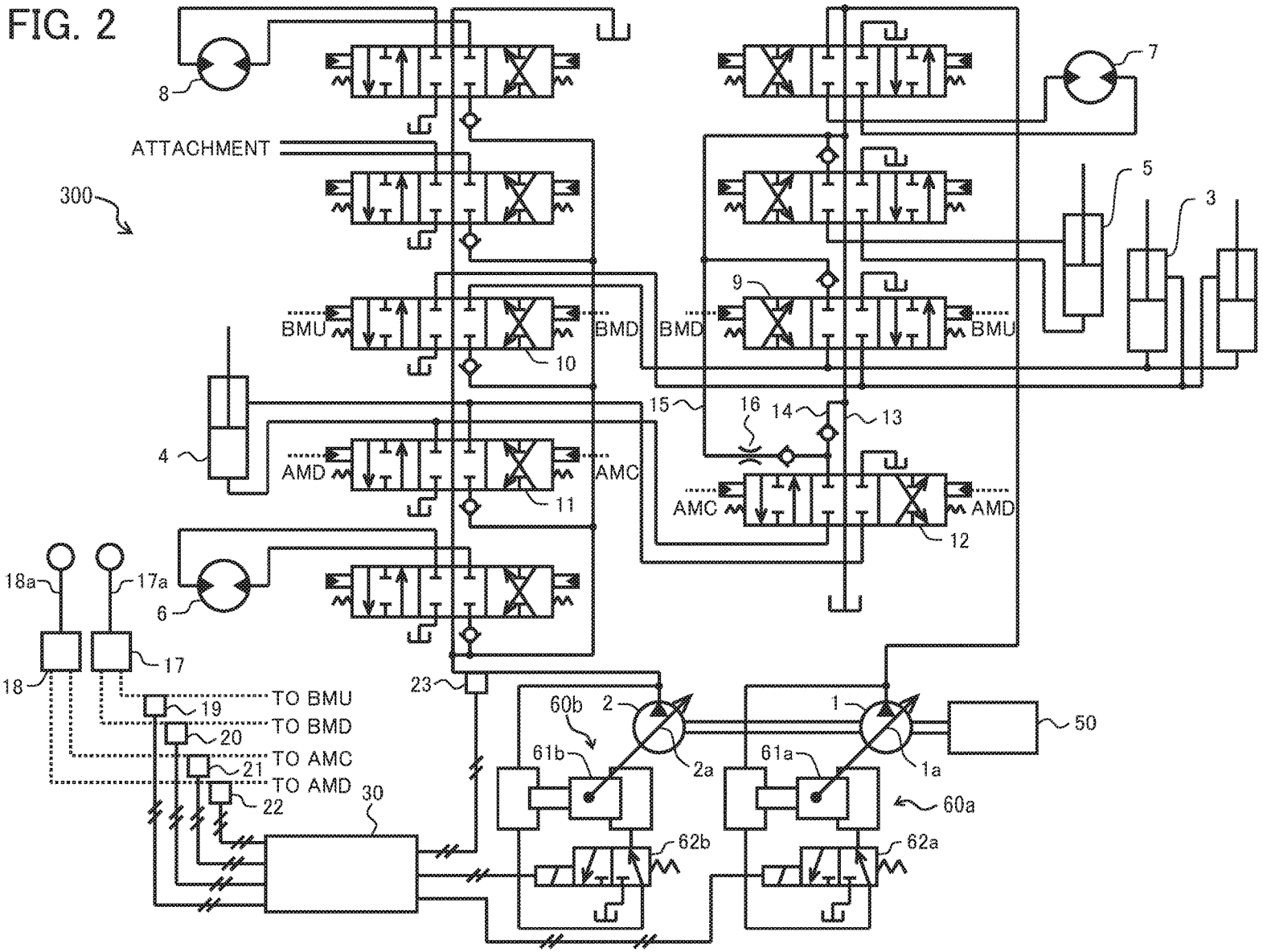
FIG. 2 is a schematic configurational diagram of a hydraulic drive system mounted on the hydraulic excavator illustrated in FIG. 1.

FIG. 2 is a schematic configurational diagram of a hydraulic drive system mounted on the hydraulic excavator 200 illustrated in FIG. 1. Note that, for simplification of explanation, illustration of portions related to operation of hydraulic actuators other than the boom cylinders 3 and arm cylinder 4 is partially omitted.

In FIG. 2, a hydraulic drive system 300 includes: an engine 50 as a prime mover; first and second hydraulic pumps 1 and 2 that are of variable displacement type and driven by the engine 50; the boom cylinders 3; the arm cylinder 4; the bucket cylinder 5; the swing motor 6; the left and right travel motors 7 and 8; boom flow control valves 9 and 10 that supply and discharge hydraulic fluids of the boom cylinders 3; arm flow control valves 11 and 12 that control supply and discharge of a hydraulic fluid of the arm cylinder 4; other flow control valves that control supply and discharge of hydraulic fluids of hydraulic actuators other than the boom cylinders 3 or the arm cylinder 4; a pilot-type boom operation lever device 17 that gives an instruction about operation of the boom cylinders 3; a pilot-type arm operation lever device 18 that gives an instruction about operation of the arm cylinder 4; first and second regulators 60*a* and 60*b* that respectively adjust tilting amounts (displacement volumes) of displacement varying members (swash plates) 1*a* and 2*a* provided to the first and second hydraulic pumps 1 and 2, respectively; and a controller 30 that controls the first and second regulators 60*a* and 60*b*.

The first hydraulic pump 1 is connected with: a flow control valve for controlling supply and discharge of a hydraulic fluid to and from the travel motor 7; a flow control valve for controlling supply and discharge of a hydraulic fluid to and from the bucket cylinder 5; the boom flow control valve 9 for controlling supply and discharge of a hydraulic fluid to and from the boom cylinders 3; and the arm flow control valve 12 for controlling supply and discharge of a hydraulic fluid to and from the arm cylinder 4, sequentially from the upstream side, and the flow control valve for controlling supply and discharge of a hydraulic fluid to and from the bucket cylinder 5, and subsequent valves are connected in tandem/parallel.

In addition, the second hydraulic pump 2 is connected in tandem/parallel with a flow control valve for controlling supply and discharge of a hydraulic fluid to and from the swing motor 6; the arm flow control valve 11 for controlling supply and discharge of a hydraulic fluid to and from the arm cylinder 4; the boom flow control valve 10 for controlling supply and discharge of a hydraulic fluid to and from the boom cylinders 3; a flow control valve for controlling supply and discharge of a hydraulic fluid to and from an attachment; and a flow control valve for controlling supply and discharge of a hydraulic fluid to and from the travel motor 8, sequentially from the upstream side.

The first regulator 60*a* has a tilt control piston 61*a* that drives the displacement varying member 1*a*, and a proportional solenoid valve 62*a* that generates an operation pressure of the tilt control piston 61*a* according to a command current inputted from the controller 30. Similarly, the second regulator 60*b* has a tilt control piston 61*b* that drives the displacement varying member 2*a*, and a proportional solenoid valve 62*b* that generates an operation pressure of the tilt control piston 61*b* according to a command current inputted from the controller 60.

The boom flow control valves 9 and 10 are driven leftward as seen in the figure by a pilot pressure (boom raising pilot pressure BMU) outputted from the boom operation lever device 17 when an operation lever (boom operation lever) 17*a* of the boom operation lever device 17 is operated toward the boom raising side. Thereby, fluids delivered from the first and second hydraulic pumps 1 and 2 are supplied to the bottom side of the boom cylinders 3, and additionally a fluid discharged from the rod side of the boom cylinders 3 is fed back to a tank, thereby causing an extending action of the boom cylinders 3.

In addition, the boom flow control valves 9 and 10 are driven rightward as seen in the figure by a pilot pressure (boom lowering pilot pressure BMD) outputted from the boom operation lever device 17 when the boom operation lever 17*a* is operated toward the boom lowering side. Thereby, fluids delivered from the first and second hydraulic pumps 1 and 2 are supplied to the rod side of the boom cylinders 3, and additionally a fluid discharged from the bottom side of the boom cylinders 3 is fed back to a tank, thereby causing a contracting action of the boom cylinders 3.

The arm flow control valves 11 and 12 are driven rightward as seen in the figure by a pilot pressure (arm crowding pilot pressure AMC) outputted from the arm operation lever device 18 when an operation lever (arm operation lever) 18*a* of the arm operation lever device 18 is operated toward the boom crowding side. Thereby, fluids delivered from the first and second hydraulic pumps 1 and 2 are supplied to the bottom side of the arm cylinder 4, and additionally a fluid discharged from the rod side of the arm cylinder 4 is fed back to a tank, thereby causing an extending action of the arm cylinder 4.

In addition, the arm flow control valves 11 and 12 are driven leftward as seen in the figure by a pilot pressure (arm dumping pilot pressure AMD) outputted from the arm operation lever device 18 when the arm operation lever 18*a* is operated toward the arm dumping side. Thereby, fluids delivered from the first and second hydraulic pumps 1 and 2 are supplied to the rod side of the arm cylinder 4, and additionally a fluid discharged from the bottom side of the arm cylinder 4 is fed back to a tank, thereby causing a contracting action of the arm cylinder 4.

A pilot line that guides the boom raising pilot pressure BMU outputted from the boom operation lever device 17 to each pressure-receiving section on the left side as seen in the figure of the boom flow control valve 9 or 10 is provided with a pressure sensor 19 that senses the boom raising pilot pressure BMU, and a pilot line that guides the boom lowering pilot pressure BMD outputted from the boom operation lever device 17 to each pressure-receiving section on the right side as seen in the figure of the boom flow control valve 9 or 10 is provided with a pressure sensor 20 that senses the boom lowering pilot pressure BMD.

A pilot line that guides the arm crowding pilot pressure AMC outputted from the arm operation lever device 18 to each pressure-receiving section on the right side as seen in the figure of the arm flow control valve 11 or 12 is provided with a pressure sensor 21 that senses the arm crowding pilot pressure AMC, and a pilot line that guides the arm dumping pilot pressure AMD outputted from the arm operation lever device 18 to each pressure-receiving section on the left side as seen in the figure of the arm flow control valve 11 or 12 is provided with a pressure sensor 22 that senses the arm dumping pilot pressure AMD.

A hydraulic fluid supply line to be supplied with a fluid delivered from the second hydraulic pump 2 is provided with a pressure sensor 23 that senses the delivery pressure of the second hydraulic pump 2.

The controller 30 receives input of sensing signals (pilot pressures) of the pressure sensors 19, 20, 21 and 22, and a sensing signal (a delivery pressure of the second hydraulic pump 2) of the pressure sensor 23 to perform predetermined calculation processes, and outputs command currents to the proportional solenoid valves 62*a* and 62*b* of the first and second regulators 60*a* and 60*b*.

Figure 3:
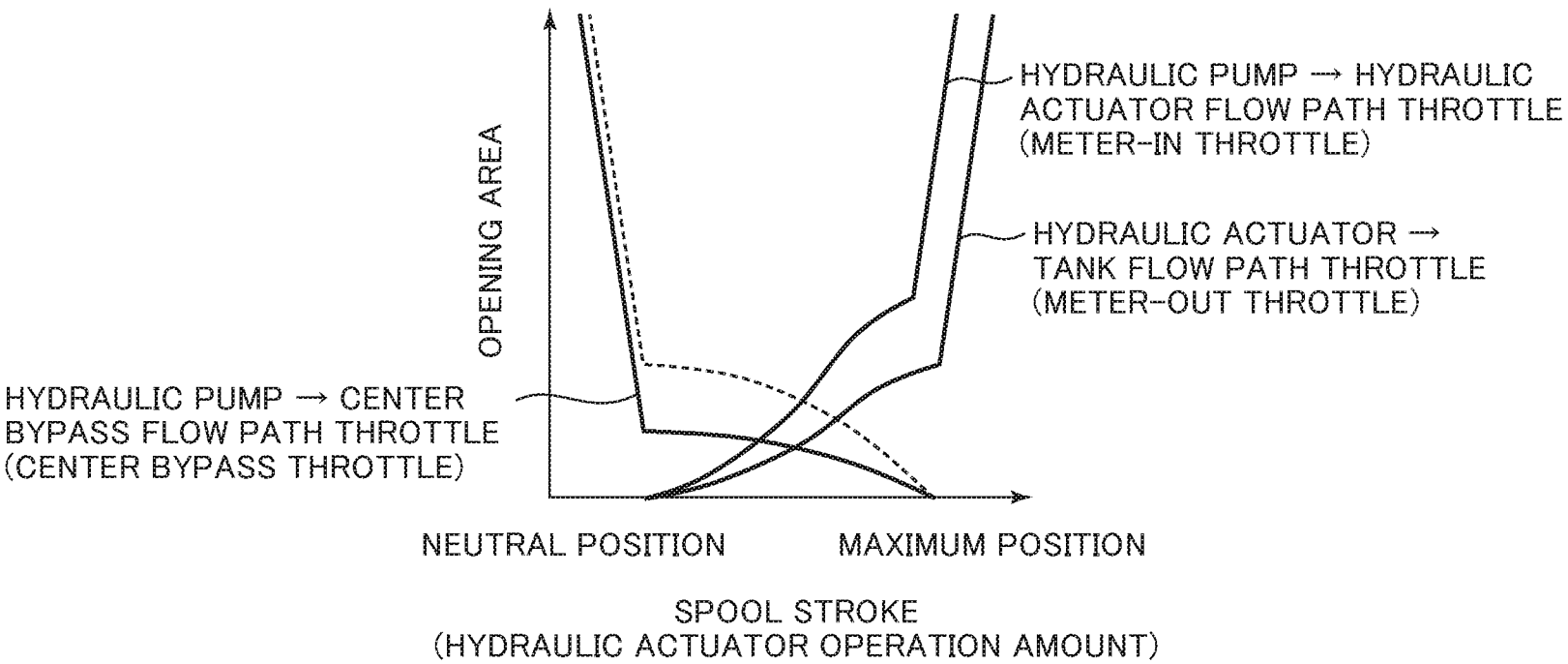
FIG. 3 is a figure schematically illustrating a relationship between the spool stroke (pilot pressure) of a flow control valve illustrated in FIG. 2, and the opening area of each restrictor.

The hydraulic circuit illustrated in FIG. 2 is an so-called open-center circuit. In this circuit, by setting the relationship between the spool strokes of the flow control valves 9, 10, 11 and 12, and the opening areas of individual restrictors to the one illustrated in FIG. 3, the flow rates of hydraulic fluids supplied from the first and second hydraulic pumps 1 and 2 to the hydraulic actuators 3 and 4 (hereinafter, referred to as meter-in flow rates), and the flow rates of hydraulic fluids fed back from the first and second hydraulic pumps 1 and 2 to the tank via a center bypass flow path (hereinafter, referred to as bleed-off flow rates) are controlled according to spool strokes, that is, the operation amounts (lever operation amounts) of the operation levers 17*a* and 18*a*.

For example, if the operation levers 17*a* and 18*a* are at their neutral positions, only the center bypass restrictor is opened, and so all the hydraulic fluids are fed back to the tank. If they are at their intermediate positions, both the center bypass restrictor and meter-in restrictor are opened, and so part of the hydraulic fluids are fed back to the tank while the remaining part of the hydraulic fluids are supplied to the hydraulic actuators 3 and 4. If they are at their maximum positions, only the meter-in restrictor is opened, and so the entire hydraulic fluids are supplied to the hydraulic actuators 3 and 4.

Figure 4:
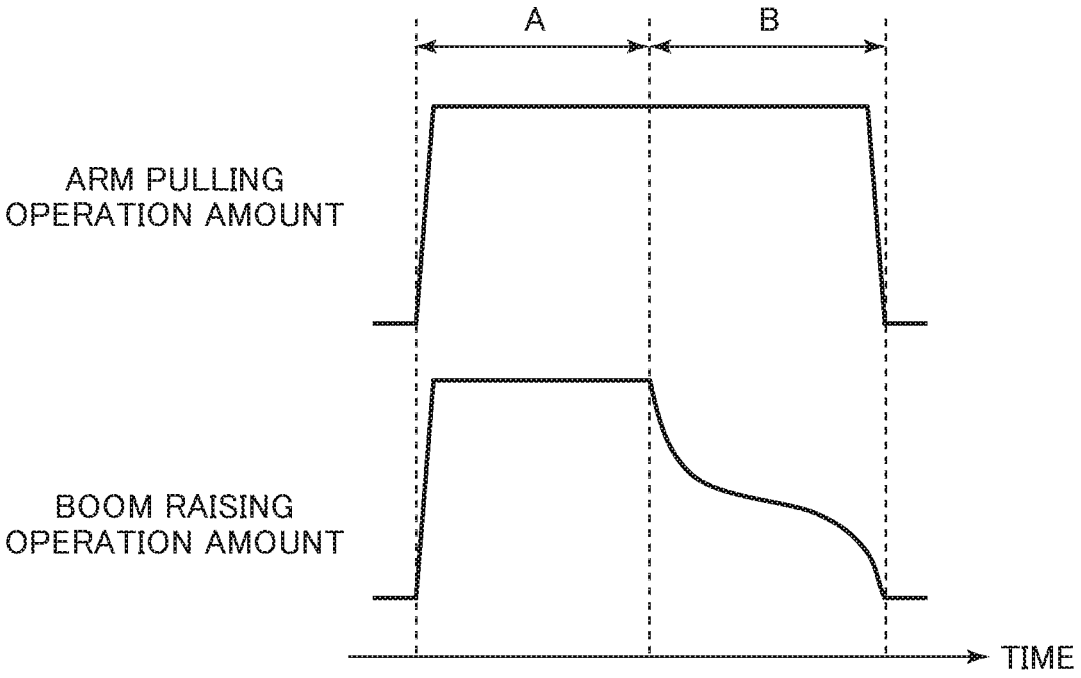
FIG. 4 is a figure schematically illustrating changes of an arm crowding operation amount and boom raising operation amount that are seen when a leveling operation is performed.

Here, a situation where an arm crowding operation and a boom raising operation are performed simultaneously (hereinafter, referred to as a leveling operation) is considered. Changes of the arm crowding operation amount and boom raising operation amount in the leveling operation are illustrated in FIG. 4. Although the operation amounts of both the arm crowding operation and boom raising operation are at the maxima immediately after the start of the operation (section A), as the arm is pulled in, the boom raising operation amount gradually decreases in order to keep the height of the claw tip of the bucket constant, while on the other hand the arm crowding operation amount remains at the maximum (section B).

Since both the arm crowding operation amount and the boom raising operation amount are at the maxima in the section A, the target displacement volumes of both the first and second hydraulic pumps 1 and 2 are also at the maximum values. Although the hydraulic fluid delivered from the second hydraulic pump 2 is supplied entirely to the arm cylinder 4 since the load pressure of the arm cylinder 4 is lower than the load pressure of the boom cylinders 3, the hydraulic fluid delivered from the first hydraulic pump 1 is supplied mostly to the boom cylinders 3 due to the action of a restrictor 16 provided in the parallel flow path 15, and part of it is supplied to the arm cylinder 4.

In contrast to this, since the arm crowding operation amount remains at the maximum in the section B, the target displacement volumes of both the first and second hydraulic pumps 1 and 2 are at the maximum values similar to the section A. Although the section B is similar to the section A also in that the hydraulic fluid delivered from the second hydraulic pump 2 is supplied entirely to the arm cylinder 4, the flow rate of the hydraulic fluid delivered from the first hydraulic pump 1 which is supplied to the boom cylinders 3 decreases due to opening of the center bypass restrictor of the boom flow control valve 9 along with decrease of the boom raising operation amount, the flow rate corresponding to the decrease (i.e., the bleed-off flow rate) is supplied to the arm cylinder 4 via a tandem flow path 14 branched off at a center bypass flow path 13.

If the opening area of the center bypass restrictor of the boom flow control valve 9 is set to a relatively large area (the broken line in FIG. 3), the bleed-off flow rate at an intermediate position is also relatively large, and so the operation speed of the arm cylinder 4 increases according to decrease of the boom raising operation amount, and the work efficiency can be improved.

On the other hand, for example, if the opening area of the center bypass restrictor of the boom flow control valve 9 is set to a relatively small area for the purpose of reducing loss caused by the bleed-off flow rate resulting from operations other than a leveling operation (a solid line in FIG. 3), the target displacement volume of the first hydraulic pump 1 remains at the maximum value in a leveling operation, and so the delivery pressure of the first hydraulic pump 1 rises as compared to that in the case explained above. As a result, there is a fear that loss caused by the bleed-off flow rate increases, and the fuel efficiency deteriorates. The hydraulic excavator 200 according to the present embodiment includes the controller 30 explained in the following embodiments, and thereby can improve the energy efficiency in leveling operations.

First Embodiment

Figure 5:
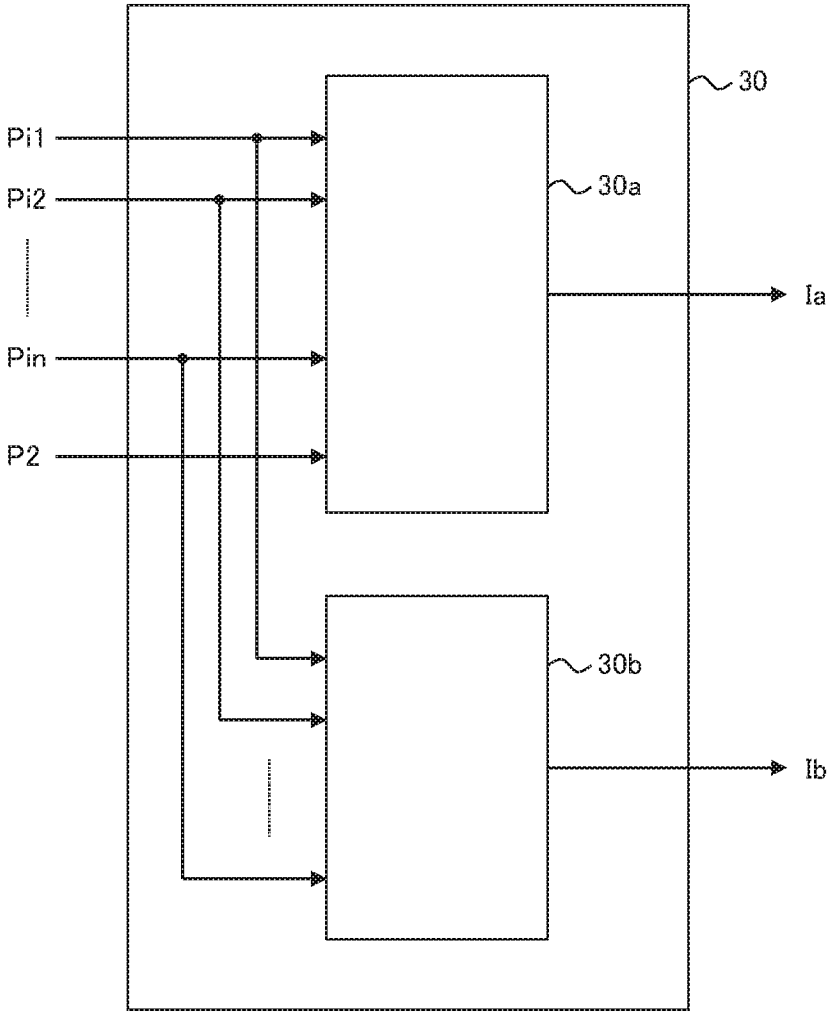
FIG. 5 is a functional block diagram of a controller in a first embodiment of the present invention.

FIG. 5 is a functional block diagram of the controller 30 in a first embodiment of the present invention.

In FIG. 5, the controller 30 has a first regulator control section 30*a* that controls the first regulator 60*a*, and a second regulator control section 30*b* that controls the second regulator 60*b*. The first regulator control section 30*a* receives input of pilot pressures Pi1, Pi2, . . . , and Pin inputted from operation devices including the operation lever devices 17 and 18, and a delivery pressure P2 of the second hydraulic pump 2 to perform predetermined calculation processes, and outputs a command current Ia to the proportional solenoid valve 62*a* of the first regulator 60*a*. On the other hand, the second regulator control section 30*b* receives input of the pilot pressures Pi1, Pi2, . . . , and Pin inputted from operation devices including the operation lever devices 17 and 18 to perform predetermined calculation processes, and outputs a command current Ib to the proportional solenoid valve 62*b* of the second regulator 60*b*.

Figure 6:
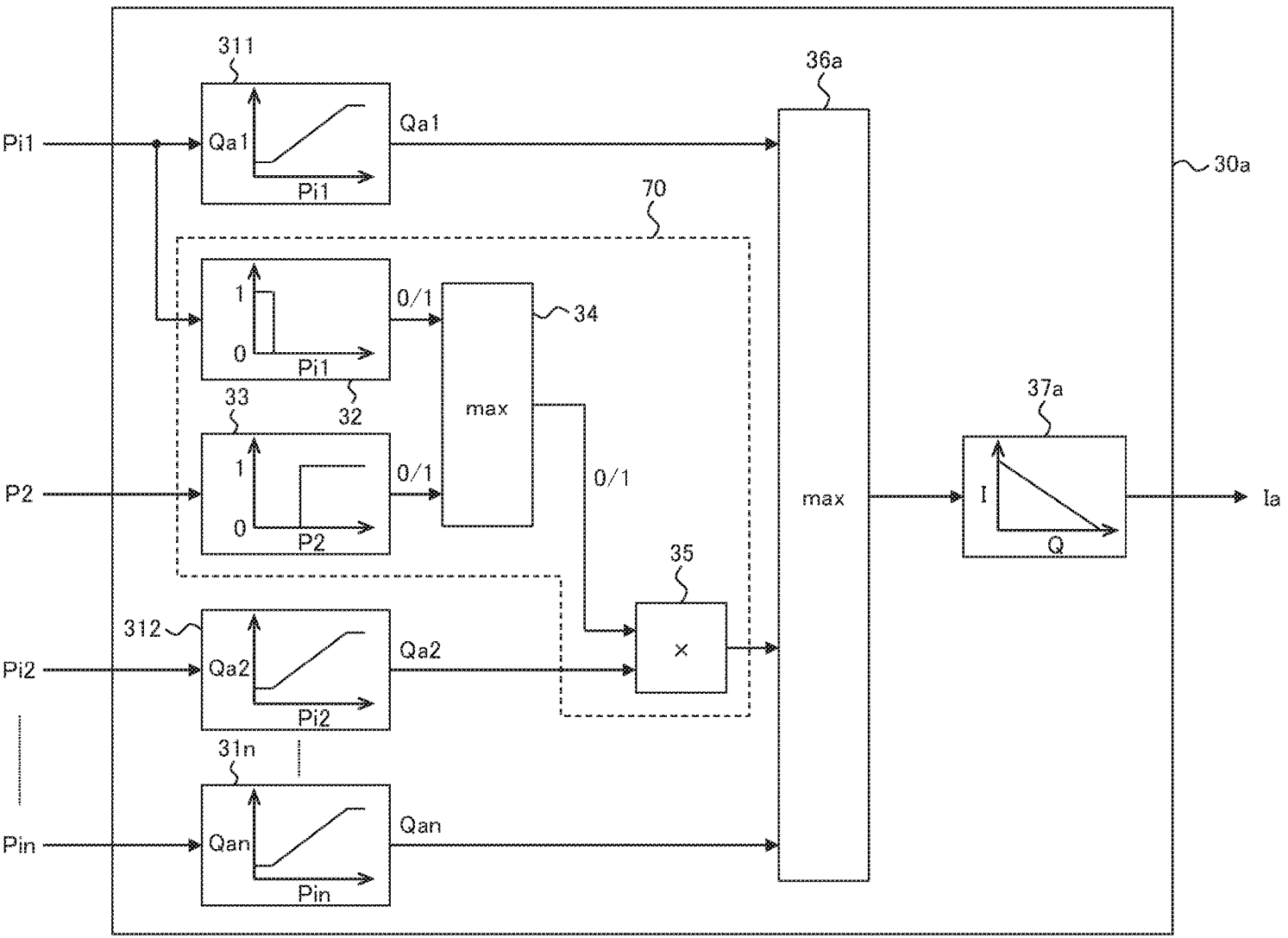
FIG. 6 is a functional block diagram of a first regulator control section provided to the controller in the first embodiment of the present invention.

FIG. 6 is a functional block diagram illustrating details of the first regulator control section 30*a*.

In FIG. 6, the first regulator control section 30*a* has displacement volume converting sections 311, 312, . . . , and 31*n*, a displacement volume restricting section 70, a maximum value selecting section 36*a*, and a command current converting section 37*a*. The displacement volume restricting section 70 has an operation determining section 32, a pressure determining section 33, a maximum value selecting section 34, and a multiplying section 35.

The displacement volume converting section 311 stores target displacement volume characteristics of the first hydraulic pump 1 in relation to the pilot pressure Pi1, converts the input pilot pressure Pi1 into target displacement volume Qa1, and outputs the target displacement volume Qa1. The displacement volume converting section 312 stores target displacement volume characteristics of the first hydraulic pump 1 in relation to the pilot pressure Pi2, converts the input pilot pressure Pi2 into target displacement volume Qa2, and outputs the target displacement volume Qa2. The displacement volume converting section 31*n* stores target displacement volume characteristics of the first hydraulic pump 1 in relation to another pilot pressure Pin, converts the input pilot pressure Pin into displacement volume Qan, and outputs the displacement volume Qan. In the following explanation, the pilot pressure Pi1 is the boom raising pilot pressure BMU, and the pilot pressure Pi2 is the arm crowding pilot pressure AMC.

The operation determining section 32 outputs 1 if the pilot pressure Pi1 (boom raising operation amount) is lower than a threshold (a predetermined operation amount) at which it is determined that a boom raising operation is being performed, and outputs 0 if the pilot pressure Pi1 is equal to or higher than the threshold. The pressure determining section 33 outputs 0 if the delivery pressure P2 of the second hydraulic pump 2 is lower than a threshold (a predetermined pressure) at which it is determined that a work with high load such as excavation is being performed, and outputs 1 if the delivery pressure P2 is equal to or higher than the threshold. The maximum value selecting section 34 selects the maximum value among the output value of the operation determining section 32, and the output value of the pressure determining section 33, and outputs the selected maximum value to the multiplying section 35. The multiplying section 35 multiplies the output value of the maximum value selecting section 34 by the output value of the displacement volume converting section 312, and outputs the product to the maximum value selecting section 36*a*. Thereby, if the boom raising operation amount Pi1 is equal to or larger than the predetermined operation amount, and the delivery pressure P2 of the second hydraulic pump 2 is lower than the predetermined pressure, the target displacement volume Qa2 of the first hydraulic pump 1 that is based on the arm crowding operation amount Pi2 is not input to the maximum value selecting section 36*a*, and so the first regulator 60*b* is controlled according only to the target displacement volume Qa1 of the first hydraulic pump 1 that is based on the boom raising operation amount Pi1.

The maximum value selecting section 36*a* selects the maximum value among the individual output values Qa1, Qa2, . . . , and Qan of the displacement volume converting sections 311, 312, . . . , and 31*n*, and the output value of the multiplying section 35, and outputs the selected maximum value to the command current converting section 37*a*. The command current converting section 37*a* outputs the command current Ia corresponding to the output value of the maximum value selecting section 36*a* to the proportional solenoid valve 62*a* of the first regulator 60*a*.

Figure 7:
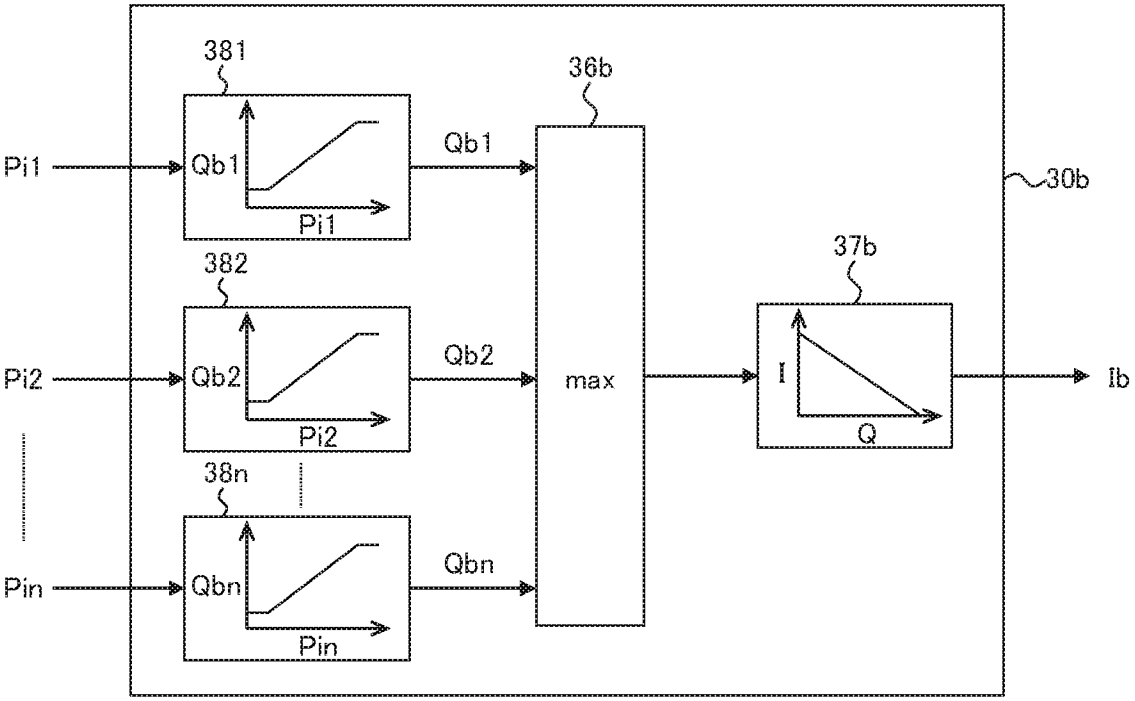
FIG. 7 is a functional block diagram of a second regulator control section provided to the controller in the first embodiment of the present invention.

FIG. 7 is a functional block diagram illustrating details of the second regulator control section 30*b*.

In FIG. 7, the second regulator control section 30*b* has displacement volume converting sections 381, 382, . . . , and 38*n*, a maximum value selecting section 36*b*, and a command current converting section 37*b*.

The displacement volume converting section 381 stores target displacement volume characteristics of the second hydraulic pump 2 in relation to the pilot pressure Pi1, converts the input pilot pressure Pi1 into displacement volume Qb1, and outputs the displacement volume Qb1. The displacement volume converting section 382 stores target displacement volume characteristics of the second hydraulic pump 2 in relation to the pilot pressure Pi2, converts the input pilot pressure Pi2 into displacement volume Qb2, and outputs the displacement volume Qb2. The displacement volume converting section 38*n* stores target displacement volume characteristics of the second hydraulic pump 2 in relation to another pilot pressure Pin, converts the input pilot pressure Pin into displacement volume Qbn, and outputs the displacement volume Qbn.

The maximum value selecting section 36*b* selects the maximum value among the individual output values Qb1, Qb2, . . . , and Qbn of the displacement volume converting sections 381, 382, . . . , and 38*n*, and outputs the selected maximum value to the command current converting section 37*b*. The command current converting section 37*b* outputs the command current Ib corresponding to the output value of the maximum value selecting section 36*b* to the proportional solenoid valve 62*b* of the second regulator 60*b*.

Next, operation of the hydraulic drive system 300 (see FIG. 2) in the present embodiment is explained.

If an operator of the hydraulic excavator 200 operates the boom operation lever 17*a* in the boom raising direction, and additionally operates the arm operation lever 18*a* in the arm crowding direction, the boom raising pilot pressure BMU acts on the pressure-receiving sections on the left side as seen in the figure of the boom flow control valves 9 and 10, and the arm crowding pilot pressure AMC acts on the pressure-receiving sections on the left side as seen in the figure of the arm flow control valves 11 and 12. At this time, the pilot pressures are sensed at the pressure sensors 19 and 21, and sensing signals are input to the controller 30 as Pi1 and Pi2. In addition, the delivery pressure of the second hydraulic pump 2 also is input to the controller 30 as a sensing signal P2 of the pressure sensor 23.

In the controller 30, while the target displacement volumes Qa1 and Qa2 of the first hydraulic pump 1 corresponding to the pilot pressures Pi1 and Pi2 is outputted from the displacement volume converting sections 311 and 312, respectively, the minimum value of target displacement volume is outputted from the displacement volume converting section 31*n* since hydraulic actuators other than the boom cylinders 3 and arm cylinder 4 are not being operated. Since a boom raising operation is being performed, and the boom raising pilot pressure Pi1 exceeds the threshold, the output value of the operation determining section 32 is 0. In addition, since a work with a high load such as excavation is not being performed, and the delivery pressure P2 of the second hydraulic pump 2 falls below the threshold, the output value of the pressure determining section 33 is 0. As a result, the output value of the maximum value selecting section 34 also is 0, and so the multiplying section 35 multiplies the target displacement volume Qa2 by 0. Accordingly, the target displacement volume Qa1 corresponding to the pilot pressure Pi1 is outputted from the maximum value selecting section 36.

Figure 8:
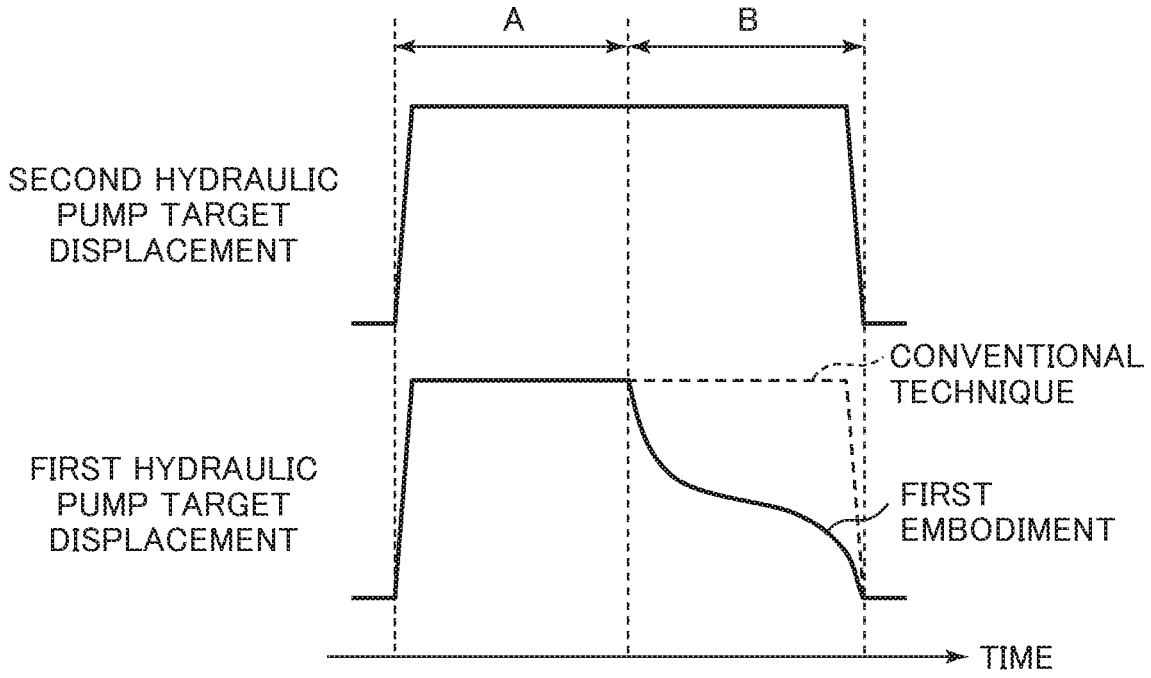
FIG. 8 is a figure schematically illustrating changes of displacement volumes of first and second hydraulic pumps that are seen when a leveling operation is performed in the first embodiment of the present invention.

Changes of displacement volumes of the first and second hydraulic pumps 1 and 2 that are seen when a leveling operation is performed in the present embodiment are illustrated in FIG. 8. The present embodiment is similar to the conventional techniques in that displacement volumes of both the first and second hydraulic pumps 1 and 2 are at the maximum values in the section A immediately after the start of the operation. In contrast to this, while the displacement volume of the second hydraulic pump 2 remains at the maximum value in the section B, the displacement volume of the first hydraulic pump 1 decreases corresponding to the pilot pressure Pi1 (a solid line in the figure). This is because input of the target displacement volume Qa2 that is based on the arm crowding operation amount Pi2 to the maximum value selecting section 36*a* is restricted by the displacement volume restricting section 70 in the first regulator control section 30*a* (see FIG. 6).

The hydraulic excavator 200 according to the present embodiment includes: the machine bodies 201 and 202; the boom 207 attached to the machine bodies 201 and 202 so as to be rotatable in the upward/downward direction; the arm 208 attached to a front end portion of the boom 207 so as to be rotatable in the upward/downward or forward/backward direction; the first and second hydraulic pumps 1 and 2 that are of variable displacement type; the first and second regulators 60*a* and 60*b* each of which adjusts the displacement volume of the first or second hydraulic pump 1 or 2; the boom cylinders 3 that is supplied with at least a fluid delivered from the first hydraulic pump 1, and drives the boom 207; the arm cylinder 4 that is supplied with at least a fluid delivered from the second hydraulic pump 2, and drives the arm 208; the boom operation device 17 that gives an instruction about operation of the boom 207; the arm operation device 18 that gives an instruction about operation of the arm 208; operation amount sensors 19, 20, 21, and 22 that sense operation amounts of the boom operation device 17 and arm operation device 18; the controller 30 that controls the first and second regulators 60*a* and 60*b* according to the operation amounts of the boom operation device 17 and arm operation device 18; and the pressure sensor 23 that senses a delivery pressure of the second hydraulic pump 2. The controller 30 controls the second regulator 60*b* according to the maximum value among the target displacement volume Qb1 of the second hydraulic pump 2 that is based on the boom raising operation amount Pi1 of the boom operation device 17, and the target displacement volume Qb2 of the second hydraulic pump 2 that is based on the arm crowding operation amount Pi2 of the arm operation device 18, controls the first regulator 60*a* according to the maximum value among the target displacement volume Qa1 of the first hydraulic pump 1 that is based on the boom raising operation amount Pi1, and the target displacement volume Qa2 of the first hydraulic pump 1 that is based on the arm crowding operation amount Pi2 if the boom raising operation amount Pi1 is smaller than a predetermined operation amount, or if the delivery pressure P2 of the second hydraulic pump 2 is equal to or higher than a predetermined pressure, and controls the first regulator 60*a* according only to the target displacement volume Qa1 of the first hydraulic pump 1 that is based on the boom raising operation amount Pi1 if the boom raising operation amount Pi1 is equal to or larger than the predetermined operation amount, and the delivery pressure P2 of the second hydraulic pump 2 is lower than the predetermined pressure.

In addition, the first regulator 60*a* has: the tilt control piston 61*a* that drives the displacement varying member 1*a* of the first hydraulic pump 1; and the proportional solenoid valve 62*a* that generates an operation pressure of the tilt control piston 61*a* according to the command current Ia inputted from the controller 30, and the controller 30 has: the first displacement volume converting section 311 that converts the boom raising operation amount Pi1 into the target displacement volume Qa1 of the first hydraulic pump 1, and outputs the target displacement volume Qa1; the second displacement volume converting section 312 that converts the arm crowding operation amount Pi2 into the target displacement volume Qa2 of the first hydraulic pump 1, and outputs the target displacement volume Qa2; the displacement volume restricting section 70 that outputs the output value Qa2 of the second displacement volume converting section 312 directly if the boom raising operation amount Pi1 is smaller than the predetermined operation amount, or if the delivery pressure P2 of the second hydraulic pump 2 is equal to or higher than the predetermined pressure, and outputs 0 if the boom raising operation amount Pi1 is equal to or larger than the predetermined operation amount, and the delivery pressure P2 of the second hydraulic pump 2 is lower than the predetermined pressure; the maximum value selecting section 36*a* that selects and outputs the maximum value among the output value Qa1 of the first displacement volume converting section 311, and the output value of the displacement volume restricting section 70; and the command current converting section 37*a* that outputs, to the proportional solenoid valve 62*a*, the command current Ia that is based on the output value of the maximum value selecting section 36*a*.

With the hydraulic excavator 200 according to the thus-configured present embodiment, the displacement volume of the first hydraulic pump 1 that supplies a hydraulic fluid mainly to the boom cylinders 3 decreases according to reduction of the boom raising operation amount Pi1 in a leveling operation in which an arm crowding operation and a boom raising operation are performed simultaneously. Thereby, the delivery pressure of the first hydraulic pump 1 never rises excessively, and so it becomes possible to improve the energy efficiency.

Second Embodiment

Figure 9:
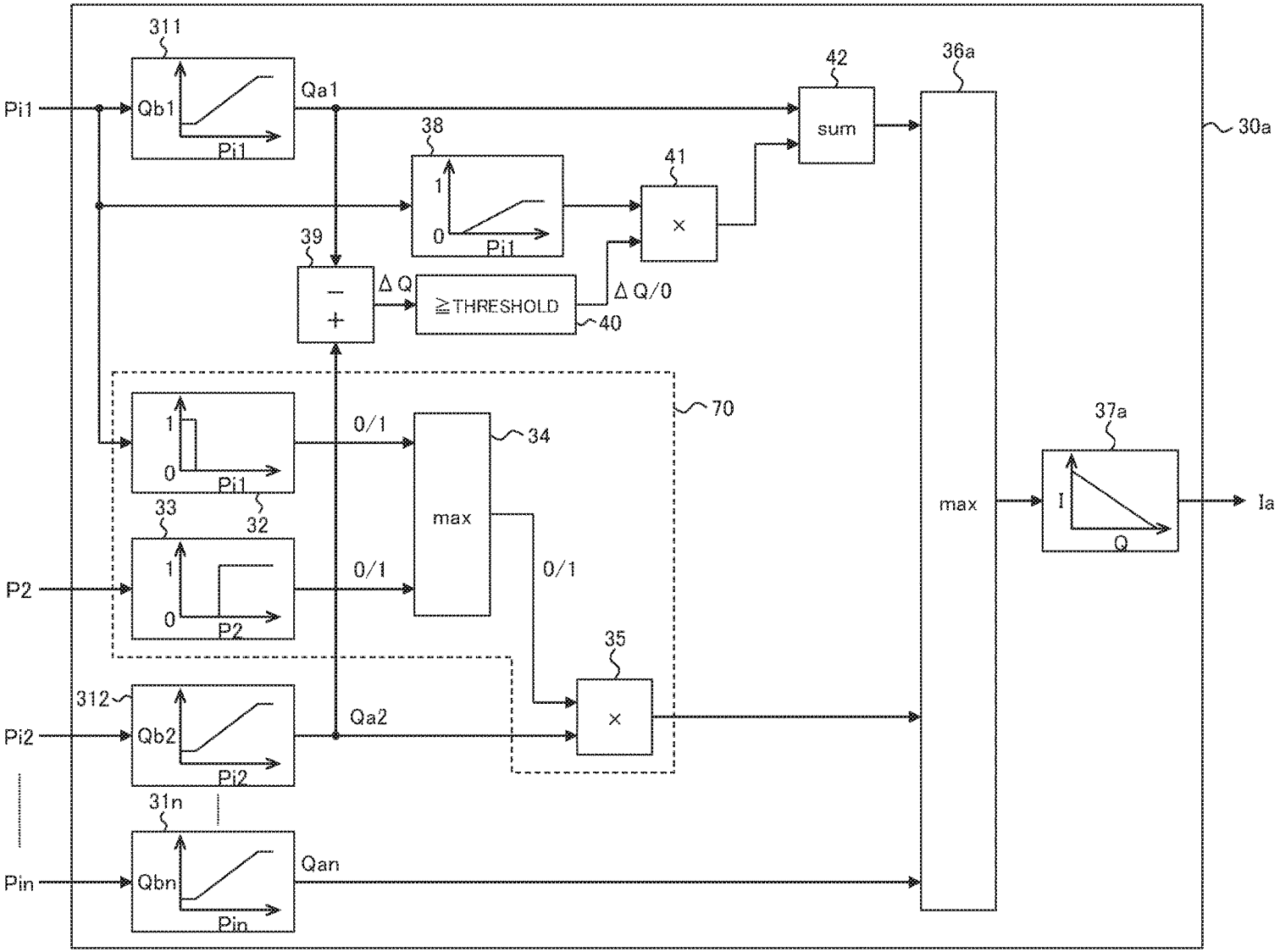
FIG. 9 is a functional block diagram of the first regulator control section provided to the controller in a second embodiment of the present invention.

FIG. 9 is a functional block diagram of the first regulator control section 30*a* provided to the controller 30 in the second embodiment of the present invention. In FIG. 9, a difference from the first embodiment (see FIG. 6) is that the first regulator control section 30*a* further has a gain generating section 38, a subtracting section 39, a comparing section 40, a multiplying section 41, and an adding section 42.

The gain generating section 38 outputs a numerical value in the range of 0 to 1 according to the boom raising operation amount Pi1. Note that the gain generating section 38 in the present embodiment is configured to output a gain proportional to the boom raising operation amount Pi1. The subtracting section 39 outputs a difference value ΔQ obtained by subtracting the target displacement volume Qa1 corresponding to a boom raising operation amount from the target displacement volume Qa2 corresponding to the arm crowding operation amount Pi2. The comparing section 40 compares the difference value ΔQ with a predetermined threshold, outputs the difference value ΔQ directly if the difference value ΔQ is equal to or larger than a threshold, and outputs 0 if the difference value ΔQ is smaller than the threshold. The multiplying section 41 multiplies the output value of the gain generating section 38 by the output value of the comparing section 40, and the adding section 42 adds the output value of the multiplying section 41 to the target displacement volume Qa1, and outputs the obtained value to the maximum value selecting section 36*a*.

Hereinafter, operation of the hydraulic drive system 300 (see FIG. 2) in the present embodiment is explained.

If an operator of the hydraulic excavator 200 operates the boom operation lever 17*a* in the boom raising direction, and additionally operates the arm operation lever 18*a* in the arm crowding direction, the target displacement volumes Qa1 and Qa2 corresponding to the boom raising operation amount and arm crowding operation amount are outputted from the displacement volume converting sections 311 and 312, respectively, and a numerical value corresponding to the pilot pressure Pi1 is outputted from the gain generating section 38.

Since the output value of the subtracting section 39 becomes 0 in the section A in FIG. 8, the output values of the comparing section 40 and multiplying section 41 also become 0, and the target displacement volume Qa1 is output directly from the adding section 42. On the other hand, since the output value ΔQ of the subtracting section 39 becomes larger than 0, and the difference value ΔQ is outputted from the comparing section 40 if it exceeds the threshold in the section B, a value obtained by adding the product of the difference value ΔQ and the output value of the gain generating section 38 to the target displacement volume Qa1 is outputted from the adding section 42.

Figure 10:
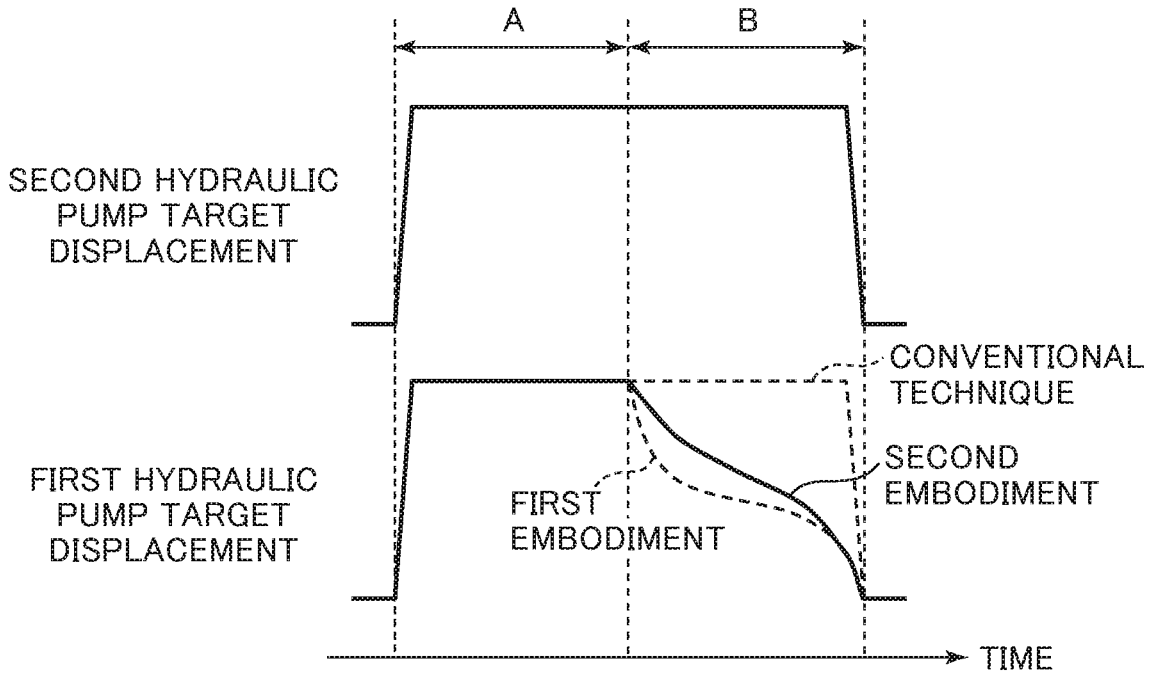
FIG. 10 is a figure schematically illustrating changes of displacement volumes of the first and second hydraulic pumps that are seen when a leveling operation is performed in the second embodiment of the present invention.

Changes of displacement volumes of the first and second hydraulic pumps 1 and 2 that are seen when a leveling operation is performed in the present embodiment are illustrated in FIG. 10. The present embodiment is similar to the first embodiment (see FIG. 8) in that displacement volumes of both the first and second hydraulic pumps 1 and 2 are at the maximum values in the section A immediately after the start of the operation. In contrast to this, while the displacement volume of the second hydraulic pump 2 remains at the maximum value in the section B, the displacement volume of the first hydraulic pump 1 increases more than in the first embodiment (the broken line in the figure).

Here, characteristics of the displacement volume converting section 311 corresponding to a boom raising operation are generally set by taking into consideration also operations other than leveling operations. Accordingly, if a boom raising operation and an arm crowding operation are performed simultaneously in the first embodiment, there is a fear that the boom raising speed decreases as compared to the case where a boom raising operation is performed singly. On the other hand, in the present embodiment, the product of the difference value ΔQ obtained by subtracting the target displacement volume Qa1 corresponding to a boom raising operation amount from the target displacement volume Qa2 corresponding to an arm crowding operation amount, and a gain corresponding to a boom raising operation amount is added to the target displacement volume Qa1, and thereby characteristics of the operation speed of the boom cylinders 3 for a boom raising operation amount can be made uniform for cases where an arm crowding operation is performed, and where an arm crowding operation is not performed.

In the present embodiment, the controller 30 adds the product of a gain that is based on the boom raising operation amount Pi1, and the difference value ΔQ to the target displacement volume Qa1 of the first hydraulic pump 1 that is based on the boom raising operation amount Pi1 if the difference value ΔQ obtained by subtracting the target displacement volume Qa1 of the first hydraulic pump 1 that is based on the boom raising operation amount Pi1 from the target displacement volume Qa2 of the first hydraulic pump 1 that is based on the arm crowding operation amount Pi2 is equal to or larger than a predetermined threshold.

In addition, the controller 30 has: the gain generating section 38 that calculates and outputs a gain corresponding to the boom raising operation amount Pi1; the subtracting section 39 that outputs the difference value ΔQ obtained by subtracting the output value Qa1 of the first displacement volume converting section 311 from the output value Qa2 of the second displacement volume converting section 312; the comparing section 40 that outputs the difference value ΔQ directly if the difference value ΔQ is equal to or larger than a predetermined threshold, and outputs 0 if the difference value ΔQ is smaller than the predetermined threshold; the multiplying section 41 that multiplies the output value of the gain generating section 38 by the output value of the comparing section 40, and outputs the product; and the adding section 42 that adds the output value of the multiplying section 41 to the output value Qa1 of the first displacement volume converting section 311.

With the hydraulic excavator 200 according to the thus-configured present embodiment, the product of the difference value ΔQ obtained by subtracting the target displacement volume Qa1 corresponding to a boom raising operation amount from the target displacement volume Qa2 corresponding to an arm crowding operation amount, and a gain corresponding to a boom raising operation amount is added to the target displacement volume Qa1, and thereby characteristics of the operation speed of the boom cylinders 3 for a boom raising operation amount can be made uniform for cases where an arm crowding operation is performed, and where an arm crowding operation is not performed. Thereby, the work efficiency can be improved while preventing deterioration of the energy efficiency in a leveling operation.

Although embodiments of the present invention are mentioned in detail thus far, the present invention is not limited to the embodiments explained above, but include various variants. For example, the embodiments explained above are explained in detail so as to explain the present invention in an easy-to-understand manner, and the present invention is not necessarily limited to embodiments including all the explained configurations. In addition, it is also possible to add some of configurations of an embodiment to configurations of another embodiment, and it is also possible to eliminate some of configurations of an embodiment, or to replace some of configurations of an embodiment with part of another embodiment.

DESCRIPTION OF REFERENCE CHARACTERS

1: First hydraulic pump
1*a*: Displacement varying member
2: Second hydraulic pump
2*a*: Displacement varying member
3: Boom cylinder
4: Arm cylinder
5: Bucket cylinder
6: Swing motor
7, 8: Travel motor
9, 10: Boom flow control valve
11, 12: Arm flow control valve
13: Center bypass flow path
14: Tandem flow path
15: Parallel flow path
16: Restrictor
17: Boom operation lever device (Boom operation device)
17*a*: Boom operation lever
18: Arm operation lever device (Arm operation device)
18*a*: Arm operation lever
19, 20, 21, 22: Pressure sensor (Operation amount sensor)
23: Pressure sensor (Pressure sensor)
30: Controller
30*a*: First regulator control section
30*b*: Second regulator control section
32: Operation determining section
33: Pressure determining section
34: Maximum value selecting section
35: Multiplying section
36*a*, 36*b*: Maximum value selecting section
37*a*, 37*b*: Command current converting section
38: Gain generating section
39: Subtracting section
40: Comparing section
50: Engine (Prime mover)
60*a*: First regulator

61*a*: Tilt control piston
62*a*: Proportional solenoid valve
60*b*: Second regulator
61*b*: Tilt control piston
62*b*: Proportional solenoid valve
70: Displacement restricting section
200: Hydraulic excavator (Construction machine)
201: Lower travel structure (Machine body)
202: Upper swing structure (Machine body)
203: Front work implement
204, 205: Crawler type travel device
206: Cabin
207: Boom
208: Arm
209: Bucket
300: Hydraulic drive system
311: Displacement converting section (First displacement converting section)
312: Displacement converting section (Second displacement converting section)
31*n*: Displacement converting section
381, 382, 38*n*: Displacement converting section

The invention claimed is:

1. A construction machine comprising:

a machine body;

a boom attached to the machine body so as to be rotatable in an upward/downward direction;

an arm attached to a front end portion of the boom so as to be rotatable in the upward/downward direction or in a forward/backward direction;

a first hydraulic pump and second hydraulic pump that are of variable displacement type;

a first regulator and a second regulator that adjust displacement volumes of the first hydraulic pump and the second hydraulic pump;

a boom cylinder that is supplied with hydraulic fluids delivered from the first hydraulic pump and the second hydraulic pump and drives the boom;

an arm cylinder that is supplied with hydraulic fluids delivered from the first hydraulic pump and the second hydraulic pump and drives the arm;

a boom operation device that gives an instruction about operation of the boom;

an arm operation device that gives an instruction about operation of the arm;

an operation amount sensor that senses operation amounts of the boom operation device and the arm operation device; and a controller that controls the first regulator and the second regulator according to the operation amounts of the boom operation device and the arm operation device, wherein the construction machine comprises a pressure sensor that senses a delivery pressure of the second hydraulic pump, the controller is configured to control the second regulator according to a maximum value among a target displacement volume of the second hydraulic pump that is based on a boom raising operation amount of the boom operation device, and a target displacement volume of the second hydraulic pump that is based on an arm crowding operation amount of the arm operation device;

control the first regulator according to a maximum value among a target displacement volume of the first hydraulic pump that is based on the boom raising operation amount, and a target displacement volume of the first hydraulic pump that is based on the arm crowding operation amount if the boom raising operation amount is smaller than a predetermined operation amount or if the delivery pressure of the second hydraulic pump is equal to or higher than a predetermined pressure; and control the first regulator according only to the target displacement volume of the first hydraulic pump that is based on the boom raising operation amount if the boom raising operation amount is equal to or larger than the predetermined operation amount, and the delivery pressure of the second hydraulic pump is lower than the predetermined pressure.

2. The construction machine according to claim 1, wherein, if a difference value obtained by subtracting the target displacement volume of the first hydraulic pump that is based on the boom raising operation amount from the target displacement volume of the first hydraulic pump that is based on the arm crowding operation amount is equal to or larger than a predetermined threshold, the controller adds a product of a gain that is based on the boom raising operation amount and the difference value to the target displacement volume of the first hydraulic pump that is based on the boom raising operation amount.

3. The construction machine according to claim 1, wherein the first regulator has: a tilt control piston that drives a displacement varying member of the first hydraulic pump; and a proportional solenoid valve that generates an operation pressure of the tilt control piston according to a command current inputted from the controller, and the controller has:

a first displacement volume converting section that converts the boom raising operation amount into the target displacement volume of the first hydraulic pump, and outputs the target displacement volume;

a second displacement volume converting section that converts the arm crowding operation amount into the target displacement volume of the first hydraulic pump, and outputs the target displacement volume;

a displacement volume restricting section that outputs an output value of the second displacement volume converting section directly if the boom raising operation amount is smaller than the predetermined operation amount or if the delivery pressure of the second hydraulic pump is equal to or higher than the predetermined pressure, and outputs 0 if the boom raising operation amount is equal to or larger than the predetermined operation amount, and the delivery pressure of the second hydraulic pump is lower than the predetermined pressure;

a maximum value selecting section that selects and outputs a maximum value among an output value of the first displacement volume converting section, and an output value of the displacement volume restricting section; and a command current converting section that outputs, to the proportional solenoid valve, a command current that is based on an output value of the maximum value selecting section.

4. The construction machine according to claim 3, wherein the controller has:

a gain generating section that calculates and outputs a gain corresponding to the boom raising operation amount;

a subtracting section that outputs a difference value obtained by subtracting the output value of the first displacement volume converting section from the output value of the second displacement volume converting section;

a comparing section that outputs the difference value directly if the difference value is equal to or larger than a predetermined threshold, and outputs 0 if the difference value is smaller than the predetermined threshold;

a multiplying section that multiplies an output value of the gain generating section and an output value of the comparing section, and outputs a value obtained by the multiplication; and an adding section that adds an output value of the multiplying section to the output value of the first displacement volume converting section.

* * * * *